US008646483B2

(12) United States Patent
Schultz et al.

(10) Patent No.: US 8,646,483 B2
(45) Date of Patent: Feb. 11, 2014

(54) CROSS-FLOW FLUIDIC OSCILLATORS FOR USE WITH A SUBTERRANEAN WELL

(75) Inventors: Roger L. Schultz, Ninnekah, OK (US); Robert Pipkin, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 463 days.

(21) Appl. No.: 12/983,144

(22) Filed: Dec. 31, 2010

(65) Prior Publication Data

US 2012/0168014 A1 Jul. 5, 2012

(51) Int. Cl.
*F15C 1/02* (2006.01)

(52) U.S. Cl.
USPC ..... 137/835; 137/836; 137/838; 137/841; 137/840

(58) Field of Classification Search
CPC ..... F15C 1/22
USPC ..... 137/833, 835, 836, 837, 839, 840, 841
See application file for complete search history.

(56) References Cited

U.S. PATENT DOCUMENTS

| | | | | |
|---|---|---|---|---|
| 2,324,819 | A | 6/1941 | Butzbach | |
| 3,111,931 | A * | 11/1963 | Bodine | 116/137 A |
| 3,238,960 | A | 3/1966 | Hatch, Jr. | |
| 3,244,189 | A * | 4/1966 | Bailey | 137/829 |
| 3,247,861 | A | 4/1966 | Bauer | |
| 3,397,713 | A * | 8/1968 | Warren | 137/835 |
| 3,407,828 | A | 10/1968 | Jones | |
| 3,444,879 | A | 5/1969 | McLeod | |
| 3,563,462 | A | 2/1971 | Bauer | |
| 3,842,907 | A | 10/1974 | Baker et al. | |
| 4,052,002 | A * | 10/1977 | Stouffer et al. | 239/4 |
| 4,127,173 | A | 11/1978 | Watkins et al. | |
| 4,151,955 | A * | 5/1979 | Stouffer | 239/11 |
| 4,276,943 | A | 7/1981 | Holmes | |

(Continued)

FOREIGN PATENT DOCUMENTS

| | | |
|---|---|---|
| EP | 0304988 B1 | 11/1992 |
| EP | 0834342 A2 | 4/1998 |

(Continued)

OTHER PUBLICATIONS

Office Action issued Feb. 1, 2013 for U.S. Appl. No. 13/624,737, 50 pages.

(Continued)

*Primary Examiner* — John Rivell
*Assistant Examiner* — Minh Le
(74) *Attorney, Agent, or Firm* — Smith IP Services, P.C.

(57) ABSTRACT

A fluidic oscillator can include an input, first and second outputs on opposite sides of a longitudinal axis of the oscillator, whereby a majority of fluid which flows through the oscillator exits the oscillator alternately via the first and second outputs, first and second paths from the input to the respective first and second outputs, and wherein the first and second paths cross each other between the input and the respective first and second outputs. Another oscillator can include an input, first and second outputs, whereby a majority of fluid flowing through the fluidic oscillator exits the oscillator alternately via the first and second outputs, first and second paths from the input to the respective first and second outputs, and a feedback path which intersects the first path, whereby reduced pressure in the feedback path influences the majority of fluid to flow via the second path.

20 Claims, 10 Drawing Sheets

(56) References Cited

U.S. PATENT DOCUMENTS

| | | | |
|---|---|---|---|
| 4,291,395 | A | 9/1981 | Holmes |
| 4,323,991 | A | 4/1982 | Holmes et al. |
| 4,550,614 | A | 11/1985 | Herzl |
| 4,838,091 | A | 6/1989 | Markland et al. |
| 4,919,204 | A | 4/1990 | Baker et al. |
| 4,969,827 | A | 11/1990 | Hahs, Jr. |
| 4,976,155 | A | 12/1990 | Challandes |
| 5,063,786 | A | 11/1991 | Sanderson et al. |
| 5,127,173 | A | 7/1992 | Thurston et al. |
| 5,135,051 | A | 8/1992 | Facteau et al. |
| 5,165,438 | A | 11/1992 | Facteau et al. |
| 5,184,678 | A | 2/1993 | Pechkov et al. |
| 5,228,508 | A | 7/1993 | Facteau et al. |
| 5,339,695 | A | 8/1994 | Kang et al. |
| 5,484,016 | A | 1/1996 | Surjaatmadja et al. |
| 5,505,262 | A | 4/1996 | Cobb |
| 5,533,571 | A | 7/1996 | Surjaatmadja et al. |
| 5,827,976 | A | 10/1998 | Stouffer et al. |
| 5,893,383 | A | 4/1999 | Facteau |
| 5,919,327 | A | 7/1999 | Smith |
| 5,947,183 | A | 9/1999 | Schneider et al. |
| 6,015,011 | A | 1/2000 | Hunter |
| 6,241,019 | B1 | 6/2001 | Davidson et al. |
| 6,336,502 | B1 | 1/2002 | Surjaatmadja et al. |
| 6,367,547 | B1 | 4/2002 | Towers et al. |
| 6,371,210 | B1 | 4/2002 | Bode et al. |
| 6,405,797 | B2 | 6/2002 | Davidson et al. |
| 6,619,394 | B2 | 9/2003 | Soliman et al. |
| 6,622,794 | B2 | 9/2003 | Zisk, Jr. |
| 6,627,081 | B1 | 9/2003 | Hilditch et al. |
| 6,644,412 | B2 | 11/2003 | Bode et al. |
| 6,691,781 | B2 | 2/2004 | Grant et al. |
| 6,719,048 | B1 | 4/2004 | Ramos et al. |
| 6,851,473 | B2 | 2/2005 | Davidson |
| 6,913,079 | B2 | 7/2005 | Tubel |
| 6,948,244 | B1 | 9/2005 | Crockett |
| 6,976,507 | B1 | 12/2005 | Webb et al. |
| 7,025,134 | B2 | 4/2006 | Byrd et al. |
| 7,114,560 | B2 | 10/2006 | Nguyen et al. |
| 7,185,706 | B2 | 3/2007 | Freyer |
| 7,213,650 | B2 | 5/2007 | Lehman et al. |
| 7,213,681 | B2 | 5/2007 | Birchak et al. |
| 7,216,738 | B2 | 5/2007 | Birchak et al. |
| 7,290,606 | B2 | 11/2007 | Coronado et al. |
| 7,318,471 | B2 | 1/2008 | Rodney et al. |
| 7,404,416 | B2 | 7/2008 | Schultz et al. |
| 7,404,441 | B2 | 7/2008 | Hocking |
| 7,405,998 | B2 | 7/2008 | Webb et al. |
| 7,409,999 | B2 | 8/2008 | Henriksen et al. |
| 7,413,010 | B2 | 8/2008 | Blauch et al. |
| 7,537,056 | B2 | 5/2009 | MacDougall |
| 8,418,725 | B2 | 4/2013 | Schultz et al. |
| 2004/0011733 | A1 | 1/2004 | Bjornsson |
| 2004/0256099 | A1 | 12/2004 | Nguyen et al. |
| 2005/0214147 | A1 | 9/2005 | Schultz et al. |
| 2006/0013427 | A1 | 1/2006 | Workman et al. |
| 2006/0039749 | A1 | 2/2006 | Gawehn |
| 2006/0104728 | A1 | 5/2006 | Erickson et al. |
| 2006/0108442 | A1 | 5/2006 | Russell et al. |
| 2007/0045038 | A1 | 3/2007 | Han et al. |
| 2007/0256828 | A1 | 11/2007 | Birchak et al. |
| 2008/0041580 | A1 | 2/2008 | Freyer et al. |
| 2008/0041581 | A1 | 2/2008 | Richards |
| 2008/0041582 | A1 | 2/2008 | Saetre et al. |
| 2008/0041588 | A1 | 2/2008 | Richards et al. |
| 2008/0047718 | A1 | 2/2008 | Orr et al. |
| 2008/0142219 | A1 | 6/2008 | Steele et al. |
| 2008/0149323 | A1 | 6/2008 | O'Malley et al. |
| 2008/0283238 | A1 | 11/2008 | Richards et al. |
| 2009/0008088 | A1 | 1/2009 | Schultz et al. |
| 2009/0008090 | A1 | 1/2009 | Schultz et al. |
| 2009/0009297 | A1 | 1/2009 | Shinohara et al. |
| 2009/0009333 | A1 | 1/2009 | Bhogal et al. |
| 2009/0009336 | A1 | 1/2009 | Ishikawa |
| 2009/0009412 | A1 | 1/2009 | Warther |
| 2009/0009437 | A1 | 1/2009 | Hwang et al. |
| 2009/0009445 | A1 | 1/2009 | Lee |
| 2009/0009447 | A1 | 1/2009 | Naka et al. |
| 2009/0032260 | A1 | 2/2009 | Schultz et al. |
| 2009/0032267 | A1 | 2/2009 | Cavender et al. |
| 2009/0078427 | A1 | 3/2009 | Patel |
| 2009/0078428 | A1 | 3/2009 | Ali |
| 2009/0101354 | A1 | 4/2009 | Holmes et al. |
| 2009/0133869 | A1 | 5/2009 | Clem |
| 2009/0151925 | A1 | 6/2009 | Richards et al. |
| 2009/0159282 | A1 | 6/2009 | Webb et al. |
| 2009/0178801 | A1 | 7/2009 | Nguyen et al. |
| 2009/0250224 | A1 | 10/2009 | Wright et al. |
| 2009/0277639 | A1 | 11/2009 | Schultz et al. |
| 2009/0277650 | A1 | 11/2009 | Casciaro et al. |
| 2010/0101773 | A1 | 4/2010 | Nguyen et al. |
| 2010/0252261 | A1 | 10/2010 | Cavender et al. |
| 2011/0042092 | A1 | 2/2011 | Fripp et al. |
| 2012/0168013 | A1 | 7/2012 | Schultz et al. |
| 2012/0168015 | A1 | 7/2012 | Schultz et al. |
| 2013/0042699 | A1 | 2/2013 | Schultz et al. |
| 2013/0048274 | A1 | 2/2013 | Schultz et al. |

FOREIGN PATENT DOCUMENTS

| | | | |
|---|---|---|---|
| EP | 1857633 | A2 | 11/2007 |
| WO | 0214647 | A1 | 2/2002 |
| WO | 03062597 | A1 | 7/2003 |
| WO | 2005093264 | A1 | 10/2005 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |

OTHER PUBLICATIONS

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Office Action issued Feb. 21, 2013 for U.S. Appl. No. 12/792,095, 26 pages.

Specification and Drawings for U.S. Appl. No. 10/650,186, filed Aug. 28, 2003, 16 pages.

Apparatus and Method of Inducing Fluidic Oscillation in a Rotating Cleaning Nozzle, ip.com, dated Apr. 24, 2007, 3 pages.

Office Action issued Mar. 14, 2013 for U.S. Appl. No. 12/983,145, 23 pages.

International Search Report and Written Opinion issued Feb. 28, 2013 for PCT Application No. PCT/US2012/050727, 12 pages.

Office Action issued May 8, 2013 for U.S. Appli. No. 12/792,095, 14 pages.

International Search Report with Written Opinion issued Apr. 12, 2012 for PCT Patent Application No. PCT/US11/053403, 17 pages.

Office Action issued Aug. 14, 2012 for U.S. Appl. No. 12/983,145, 28 pages.

Office Action issued Sep. 10, 2012 for U.S. Appl. No. 12/792,095, 59 pages.

Specification and drawings for U.S. Appl. No. 13/624,737, filed Sep. 21, 2012, 56 pages.

Office Action issued Oct. 16, 2012 for U.S. Appl. No. 12/983,153, 37 pages.

International Preliminary Report on Patentability issued Jul. 11, 2013 for PCT Patent Application No. PCT/GB2011/001760, 7 pages.

Great Britain Published Search Report issued Jun. 20, 2013 for GB PCT Patent Application No. PCT/GB2011/001758, 4 pages.

Office Action issued Jul. 5, 2013 for U.S. Appl. No. 13/624,737, 19 pages.

(56) References Cited

OTHER PUBLICATIONS

Specification and drawings for U.S. Appl. No. 13/904,777, filed May 29, 2013, 52 pages.
Office Action issued Aug. 27, 2013 for U.S. Appl. No. 12/983,145, 29 pages.
International Search Report and Written Opinion issued May 2, 2013 for PCT Application No. PCT/GB2011/001758, 10 pages.
International Search Report and Written Opinion issued May 3, 2013 for PCT Application No. PCT/GB2011/001759, 10 pages.
Office Action issued May 16, 2013 for U.S. Appl. No. 13/213,259, 46 pages.
Office Action issued Jun. 4, 2013 for U.S. Appl. No. 12/983,150, 48 pages.
Office Action issued Oct. 11, 2013 for U.S. Appl. No. 12/792,095, 18 pages.
Office Action issued Oct. 22, 2013 for U.S. Appl. No. 12/983,150, 31 pages.

* cited by examiner

CROSS-FLOW FLUIDIC OSCILLATORS FOR USE WITH A SUBTERRANEAN WELL

BACKGROUND

This disclosure relates generally to equipment utilized and operations performed in conjunction with a subterranean well and, in an example described below, more particularly provides a cross-flow fluidic oscillator.

There are many situations in which it would be desirable to produce oscillations in fluid flow in a well. For example, in steam flooding operations, pulsations in flow of the injected steam can enhance sweep efficiency. In production operations, pressure fluctuations can encourage flow of hydrocarbons through rock pores, and pulsating jets can be used to clean well screens. In stimulation operations, pulsating jet flow can be used to initiate fractures in formations. These are just a few examples of a wide variety of possible applications for oscillating fluid flow.

Therefore, it will be appreciated that improvements would be beneficial in the art of producing oscillating fluid flow in a well.

SUMMARY

In the disclosure below, a fluidic oscillator is provided which brings improvements to the art of producing oscillating fluid flow. One example is described below in which alternating fluid paths of the oscillator cross each other. Another example is described below in which the oscillator can produce relatively low frequency oscillations in fluid flow.

In one aspect, this disclosure provides to the art a fluidic oscillator for use with a subterranean well. The fluidic oscillator can include a fluid input, first and second fluid outputs on opposite sides of a longitudinal axis of the fluidic oscillator, whereby a majority of fluid which flows through the fluidic oscillator exits the fluidic oscillator alternately via the first and second fluid outputs, and first and second fluid paths from the input to the respective first and second fluid outputs. The first and second fluid paths cross each other between the fluid input and the respective first and second fluid outputs.

In another aspect, this disclosure provides to the art a fluidic oscillator which can include a feedback fluid path which intersects the first fluid path. Reduced pressure in the feedback fluid path influences the majority of fluid to flow via the second fluid path.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
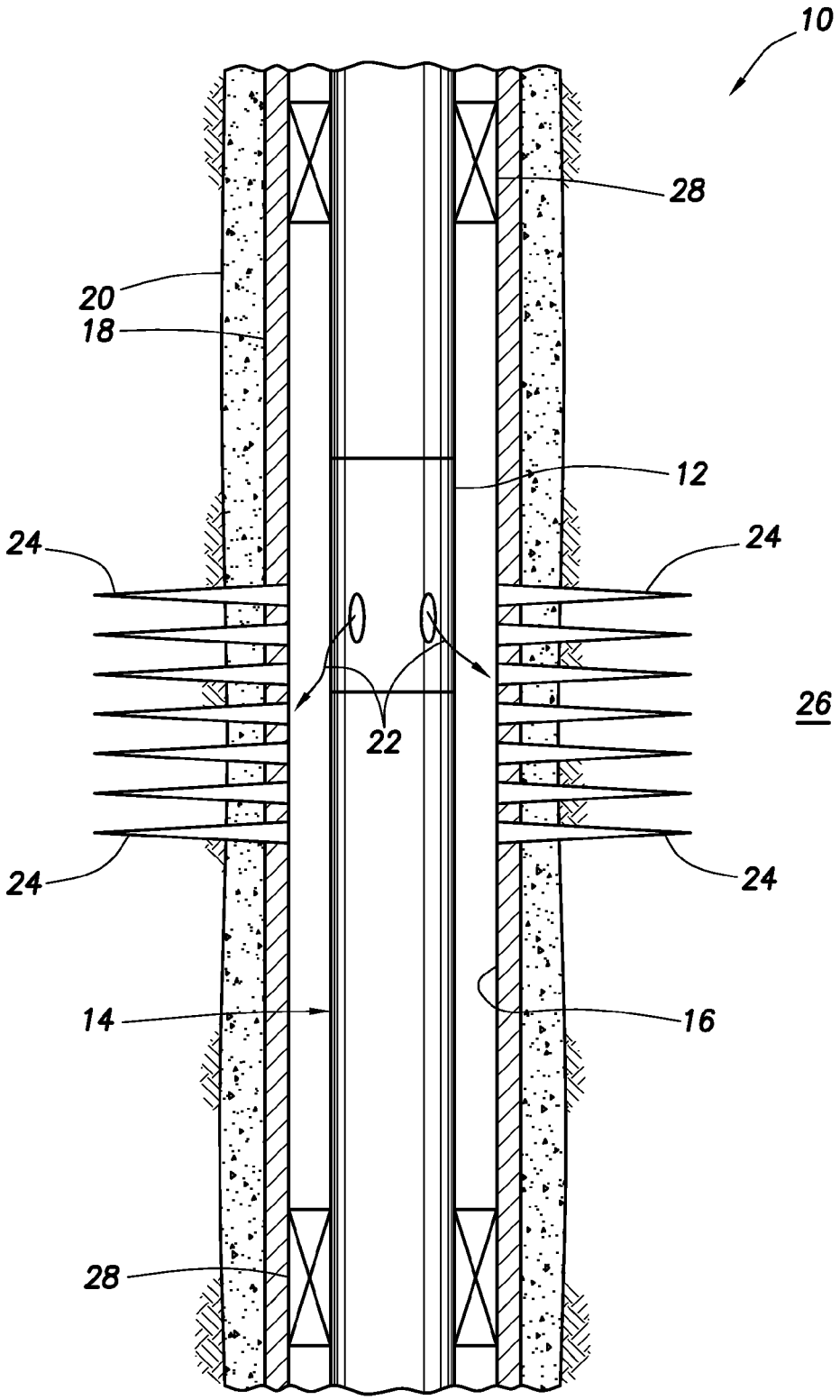
FIG. 1 is a representative partially cross-sectional view of a well system and associated method which can embody principles of the present disclosure.

Representatively illustrated in FIG. 1 is a well system 10 and associated method which can embody principles of this disclosure. In this example, a well tool 12 is interconnected in a tubular string 14 installed in a wellbore 16. The wellbore 16 is lined with casing 18 and cement 20. The well tool 12 is used to produce oscillations in flow of fluid 22 injected through perforations 24 into a formation 26 penetrated by the wellbore 16.

The fluid 22 could be steam, water, gas, fluid previously produced from the formation 26, fluid produced from another formation or another interval of the formation 26, or any other type of fluid from any source. It is not necessary, however, for the fluid 22 to be flowed outward into the formation 26 or outward through the well tool 12, since the principles of this disclosure are also applicable to situations in which fluid is produced from a formation, or in which fluid is flowed inwardly through a well tool.

Broadly speaking, this disclosure is not limited at all to the one example depicted in FIG. 1 and described herein. Instead, this disclosure is applicable to a variety of different circumstances in which, for example, the wellbore 16 is not cased or cemented, the well tool 12 is not interconnected in a tubular string 14 secured by packers 28 in the wellbore, etc.

Figure 2:
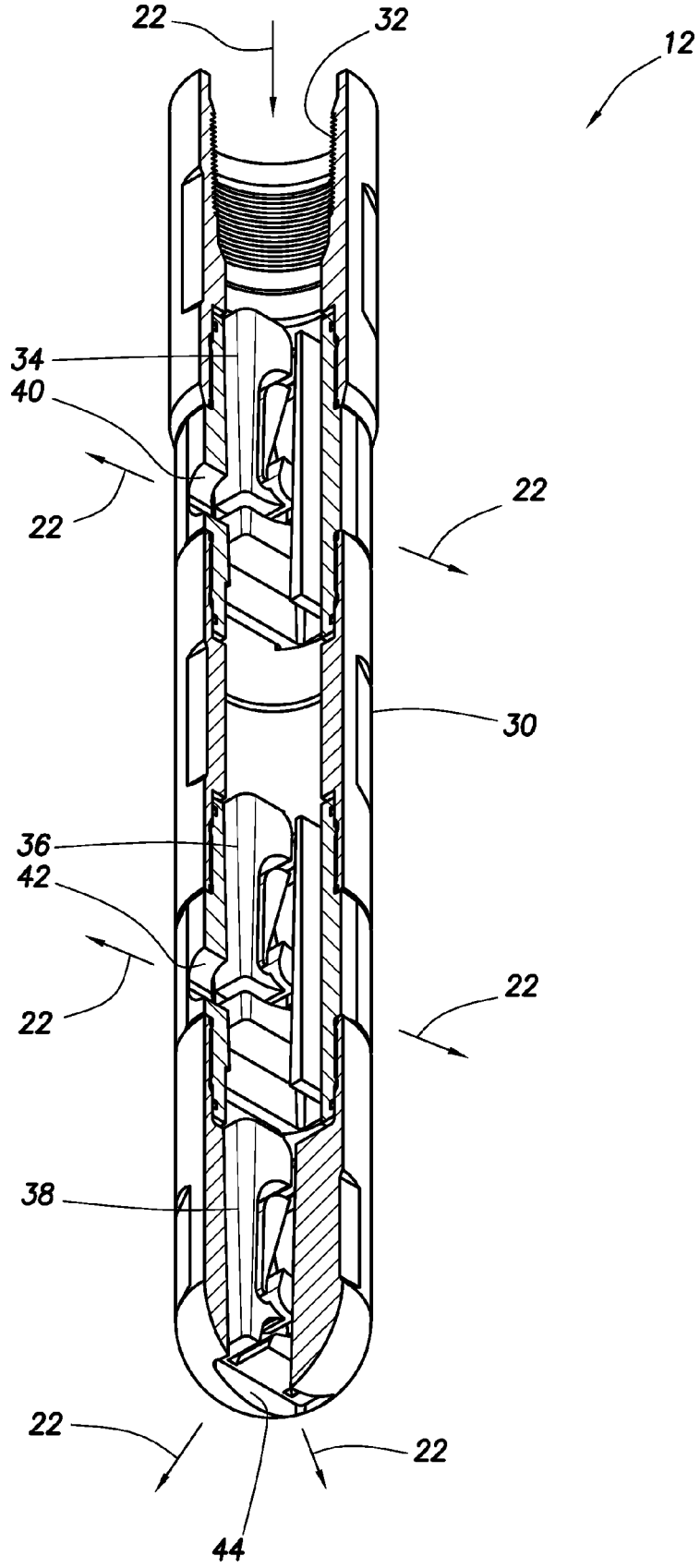
FIG. 2 is a representative partially cross-sectional isometric view of a well tool which may be used in the well system and method of FIG. 1.

Referring additionally now to FIG. 2, an example of the well tool 12 which may be used in the system 10 and method of FIG. 1 is representatively illustrated. However, the well tool 12 could be used in other systems and methods, in keeping with the principles of this disclosure.

The well tool 12 depicted in FIG. 2 has an outer housing assembly 30 with a threaded connector 32 at an upper end thereof. This example is configured for attachment at a lower end of a tubular string, and so there is not another connector at a lower end of the housing assembly 30, but one could be provided if desired.

Secured within the housing assembly 30 are three inserts 34, 36, 38. The inserts 34, 36, 38 produce oscillations in the flow of the fluid 22 through the well tool 12.

More specifically, the upper insert 34 produces oscillations in the flow of the fluid 22 outwardly through two opposing ports 40 (only one of which is visible in FIG. 2) in the housing assembly 30. The middle insert 36 produces oscillations in the flow of the fluid 22 outwardly through two opposing ports 42 (only one of which is visible in FIG. 2). The lower insert 38 produces oscillations in the flow of the fluid 22 outwardly through a port 44 in the lower end of the housing assembly 30.

Of course, other numbers and arrangements of inserts and ports, and other directions of fluid flow may be used in other examples. FIG. 2 depicts merely one example of a possible configuration of the well tool 12.

Figure 3:
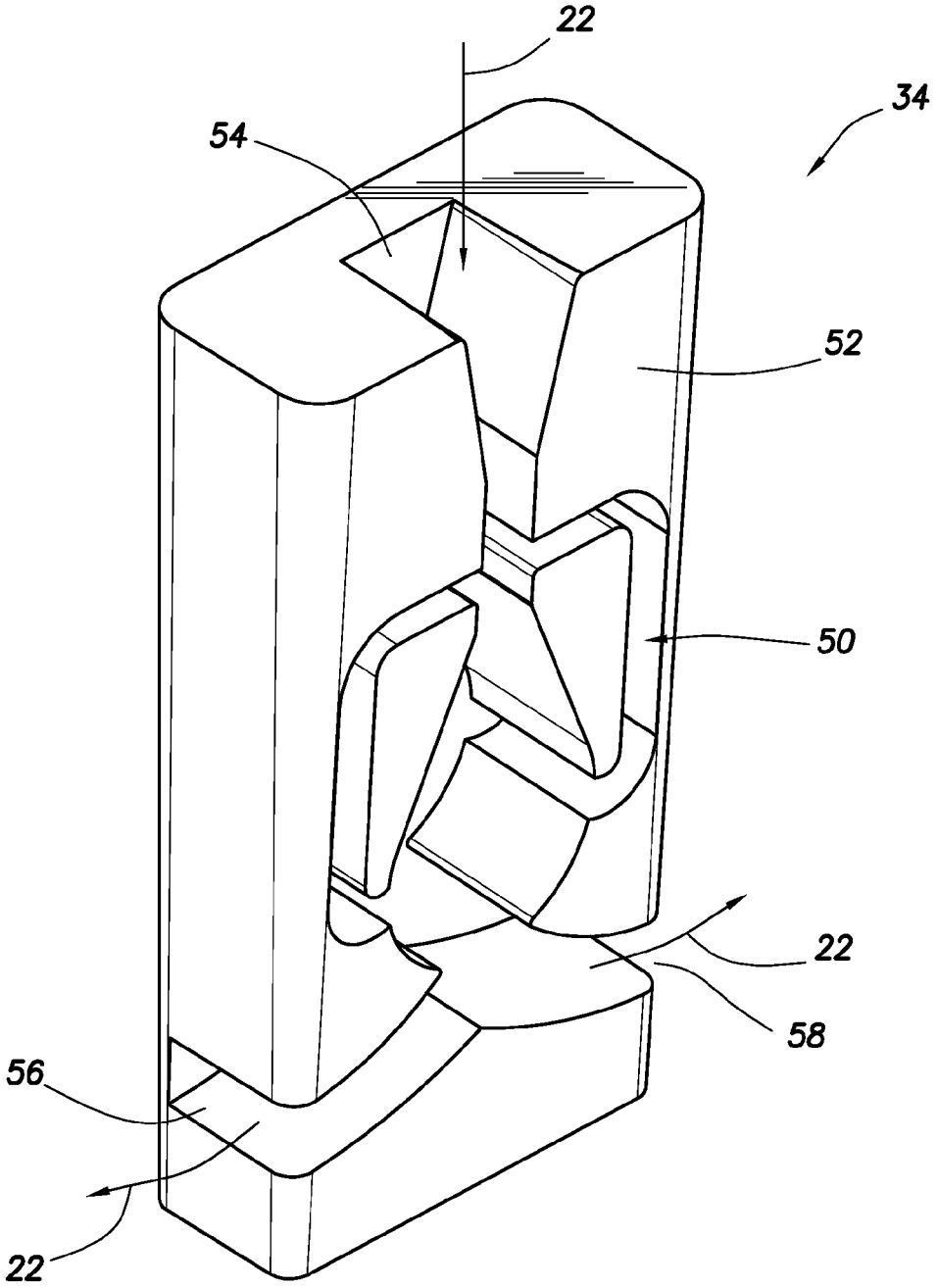
FIG. 3 is a representative isometric view of an insert which may be used in the well tool of FIG. 2.

Referring additionally now to FIG. 3, an enlarged scale view of one example of the insert 34 is representatively illustrated. The insert 34 may be used in the well tool 12 described above, or it may be used in other well tools in keeping with the principles of this disclosure.

The insert 34 depicted in FIG. 3 has a fluidic oscillator 50 machined, molded, cast or otherwise formed therein. In this example, the fluidic oscillator 50 is formed into a generally planar side 52 of the insert 34, and that side is closed off when the insert is installed in the well tool 12, so that the fluid oscillator is enclosed between its fluid input 54 and two fluid outputs 56, 58.

The fluid 22 flows into the fluidic oscillator 50 via the fluid input 54, and at least a majority of the fluid 22 alternately flows through the two fluid outputs 56, 58. That is, the majority of the fluid 22 flows outwardly via the fluid output 56, then it flows outwardly via the fluid output 58, then it flows outwardly through the fluid output 56, then through the fluid output 58, etc., back and forth repeatedly.

In the example of FIG. 3, the fluid outputs 56, 58 are oppositely directed (e.g., facing about 180 degrees relative to one another), so that the fluid 22 is alternately discharged from the fluidic oscillator 50 in opposite directions. In other examples (including some of those described below), the fluid outputs 56, 58 could be otherwise directed.

It also is not necessary for the fluid outputs 56, 58 to be structurally separated as in the example of FIG. 3. Instead, the fluid outputs 56, 58 could be different areas of a larger output opening as in the example of FIG. 7 described more fully below.

Figure 4:
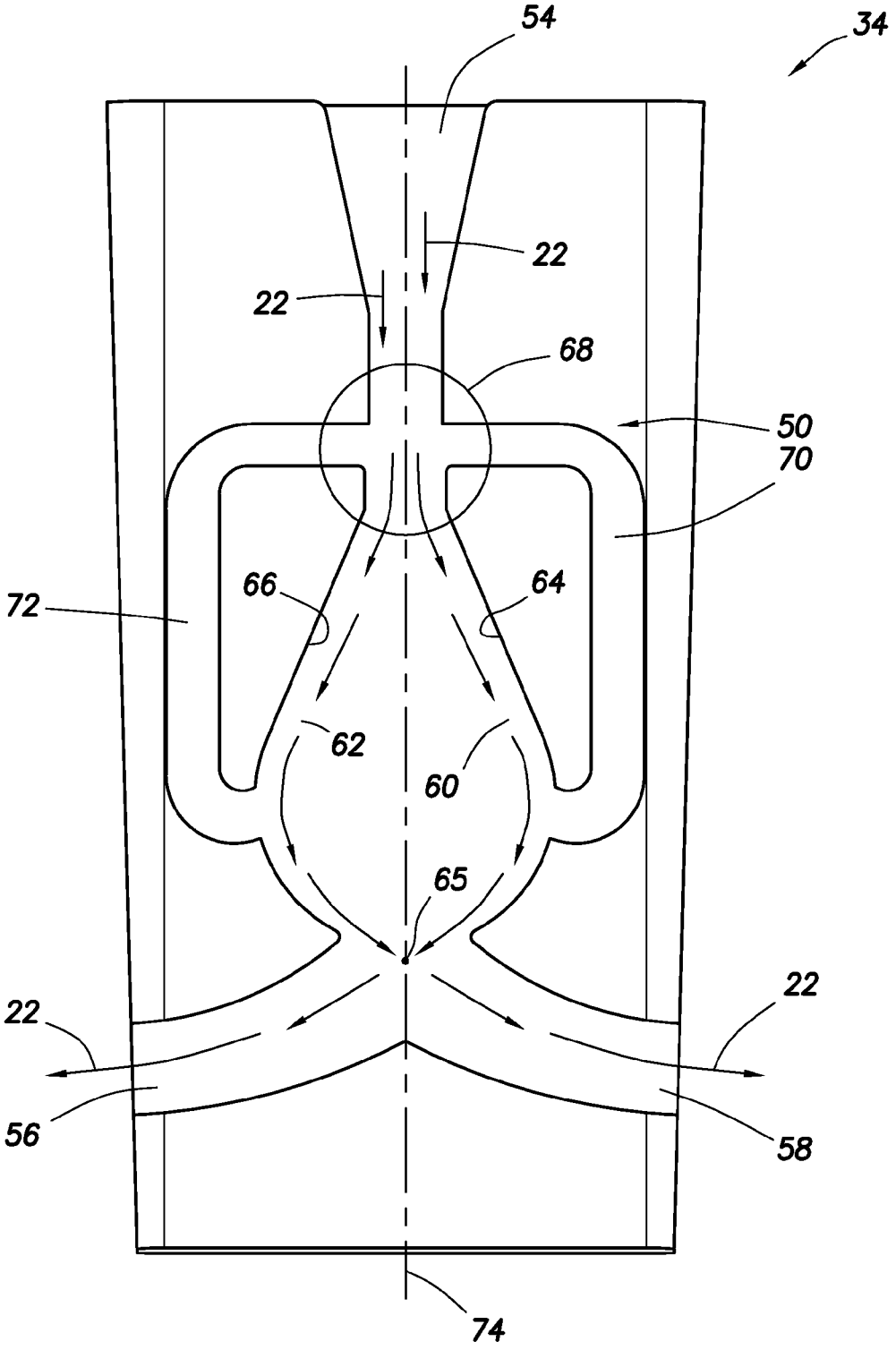
FIG. 4 is a representative elevational view of a fluidic oscillator formed in the insert of FIG. 3, which fluidic oscillator can embody principles of this disclosure.

Referring additionally now to FIG. 4, The fluidic oscillator 50 is representatively illustrated in an elevational view of the insert 34. However, it should be clearly understood that it is not necessary for the fluid oscillator 50 to be positioned in the insert 34 as depicted in FIG. 4, and the fluidic oscillator could be positioned in other inserts (such as the inserts 36, 38, etc.) or in other devices, in keeping with the principles of this disclosure.

The fluid 22 is received into the fluidic oscillator 50 via the input 54, and a majority of the fluid flows from the input to either the output 56 or the output 58 at any given point in time. The fluid 22 flows from the input 54 to the output 56 via one fluid path 60, and the fluid flows from the input to the other output 58 via another fluid path 62.

In one unique aspect of the fluidic oscillator 50, the two fluid paths 60, 62 cross each other at a crossing 65. A location of the crossing 65 is determined by shapes of walls 64, 66 of the fluidic oscillator 50 which outwardly bound the flow paths 60, 62.

When a majority of the fluid 22 flows via the fluid path 60, the well-known Coanda effect tends to maintain the flow adjacent the wall 64. When a majority of the fluid 22 flows via the fluid path 62, the Coanda effect tends to maintain the flow adjacent the wall 66.

A fluid switch 68 is used to alternate the flow of the fluid 22 between the two fluid paths 60, 62. The fluid switch 68 is formed at an intersection between the inlet 54 and the two fluid paths 60, 62.

A feedback fluid path 70 is connected between the fluid switch 68 and the fluid path 60 downstream of the fluid switch and upstream of the crossing 65. Another feedback fluid path 72 is connected between the fluid switch 68 and the fluid path 62 downstream of the fluid switch and upstream of the crossing 65.

When pressure in the feedback fluid path 72 is greater than pressure in the other feedback fluid path 70, the fluid 22 will be influenced to flow toward the fluid path 60. When pressure in the feedback fluid path 70 is greater than pressure in the other feedback fluid path 72, the fluid 22 will be influenced to flow toward the fluid path 62. These relative pressure conditions are alternated back and forth, resulting in a majority of the fluid 22 flowing alternately via the fluid paths 60, 62.

For example, if initially a majority of the fluid 22 flows via the fluid path 60 (with the Coanda effect acting to maintain the fluid flow adjacent the wall 64), pressure in the feedback fluid path 70 will become greater than pressure in the feedback fluid path 72. This will result in the fluid 22 being influenced (in the fluid switch 68) to flow via the other fluid path 62.

When a majority of the fluid 22 flows via the fluid path 62 (with the Coanda effect acting to maintain the fluid flow adjacent the wall 66), pressure in the feedback fluid path 72 will become greater than pressure in the feedback fluid path 70. This will result in the fluid 22 being influenced (in the fluid switch 68) to flow via the other fluid path 60.

Thus, a majority of the fluid 22 will alternate between flowing via the fluid path 60 and flowing via the fluid path 62. Note that, although the fluid 22 is depicted in FIG. 4 as simultaneously flowing via both of the fluid paths 60, 62, in practice a majority of the fluid 22 will flow via only one of the fluid paths at a time.

Note that the fluidic oscillator 50 of FIG. 4 is generally symmetrical about a longitudinal axis 74. The fluid outputs 56, 58 are on opposite sides of the longitudinal axis 74, the feedback fluid paths 70, 72 are on opposite sides of the longitudinal axis, etc.

Figure 5:
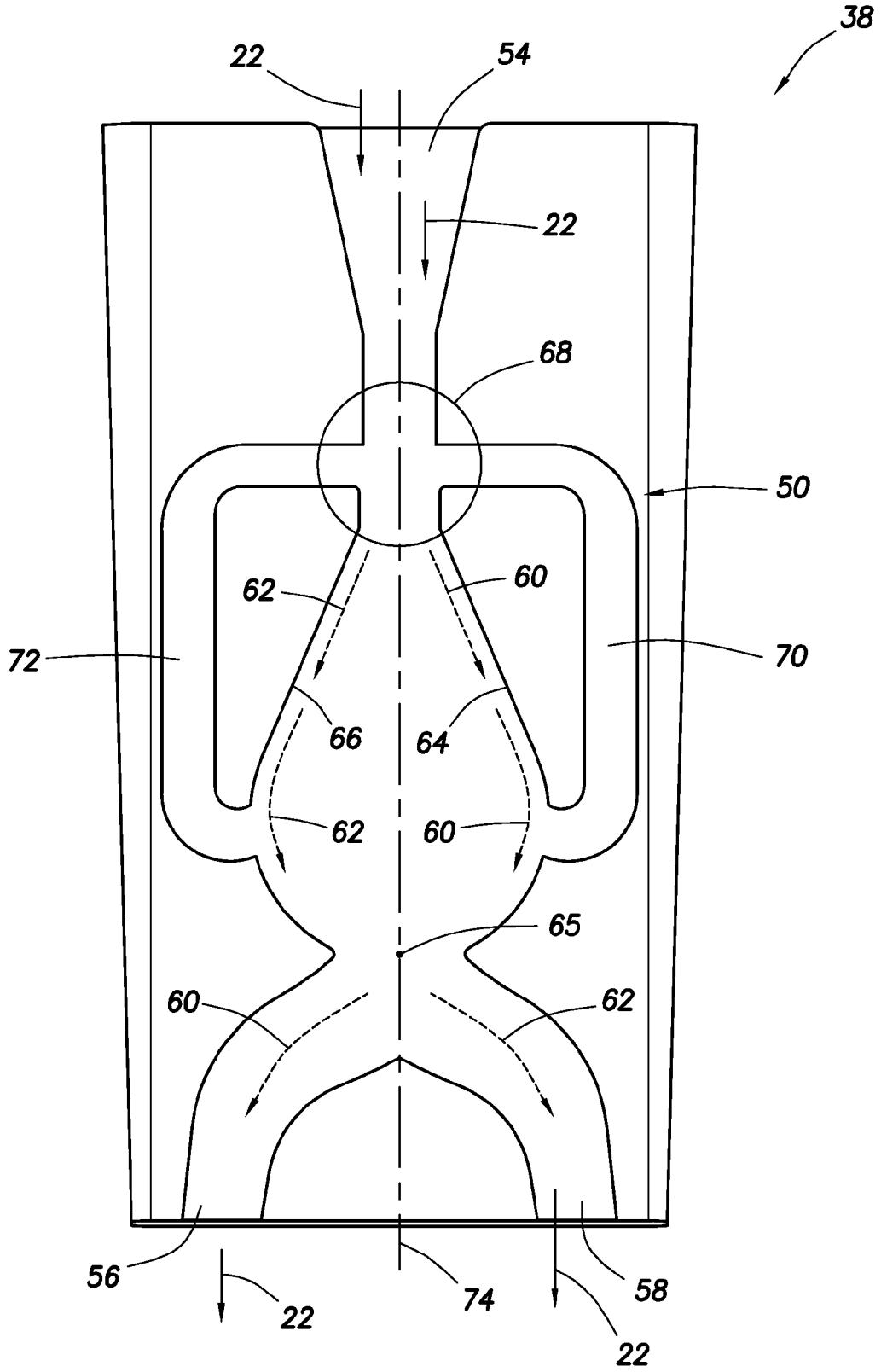
FIGS. 5-10 are additional configurations of the fluidic oscillator.

Referring additionally now to FIG. 5, another configuration of the fluidic oscillator 50 is representatively illustrated. In this configuration, the fluid outputs 56, 58 are not oppositely directed.

Instead, the fluid outputs 56, 58 discharge the fluid 22 in the same general direction (downward as viewed in FIG. 5). As such, the fluidic oscillator 50 of FIG. 5 would be appropriately configured for use in the lower insert 38 in the well tool 12 of FIG. 2.

Figure 6:
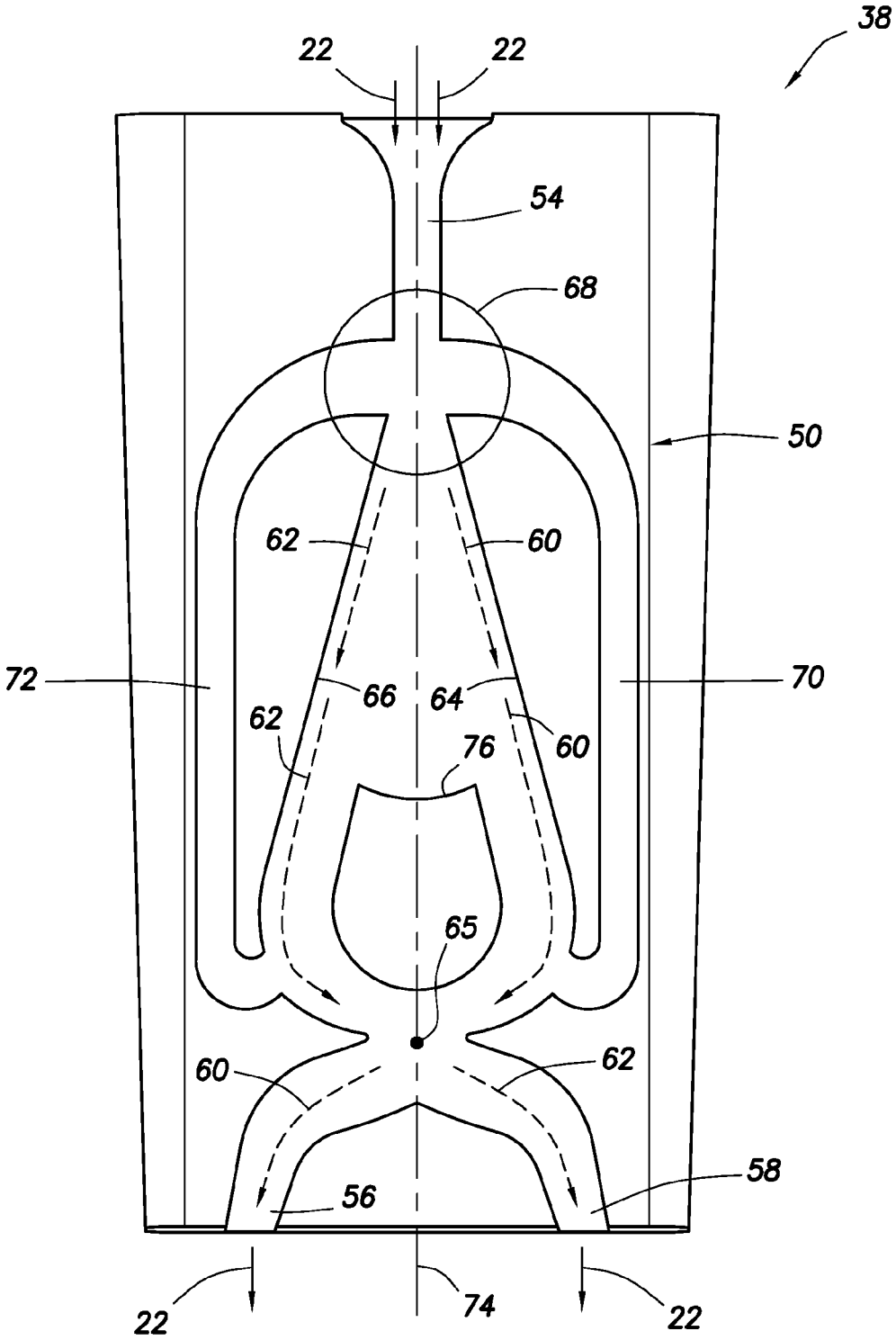

Referring additionally now to FIG. 6, another configuration of the fluidic oscillator 50 is representatively illustrated. In this configuration, a structure 76 is interposed between the fluid paths 60, 62 just upstream of the crossing 65.

The structure 76 beneficially reduces a flow area of each of the fluid paths 60, 62 upstream of the crossing 65, thereby increasing a velocity of the fluid 22 through the crossing and somewhat increasing the fluid pressure in the respective feedback fluid paths 70, 72.

This increased pressure is alternately present in the feedback fluid paths 70, 72, thereby producing more positive switching of fluid paths 60, 62 in the fluid switch 68. In addition, when initiating flow of the fluid 22 through the fluidic oscillator 50, an increased pressure difference between the feedback fluid paths 70, 72 helps to initiate the desired switching back and forth between the fluid paths 60, 62.

Figure 7:
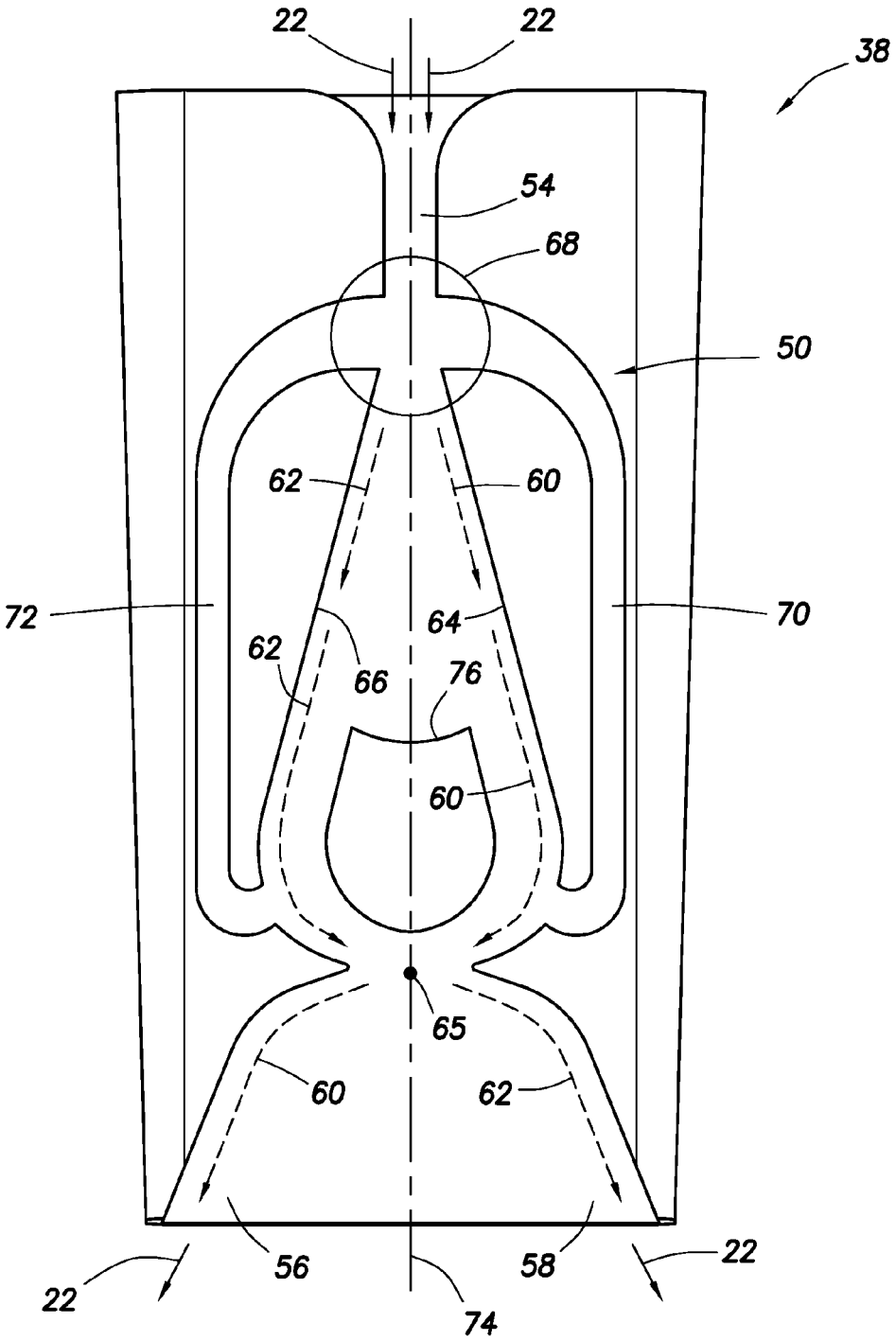

Referring additionally now to FIG. 7, another configuration of the fluidic oscillator 50 is representatively illustrated. In this configuration, the fluid outputs 56, 58 are not separated by any structure.

However, a majority of the fluid 22 will exit the fluidic oscillator 50 of FIG. 7 via either the fluid path 60 or the fluid path 62 at any given time. Therefore, the fluid outputs 56, 58 are defined by the regions of the fluidic oscillator 50 via which the fluid 22 exits the fluidic oscillator along the respective fluid paths 60, 62.

Figure 8:
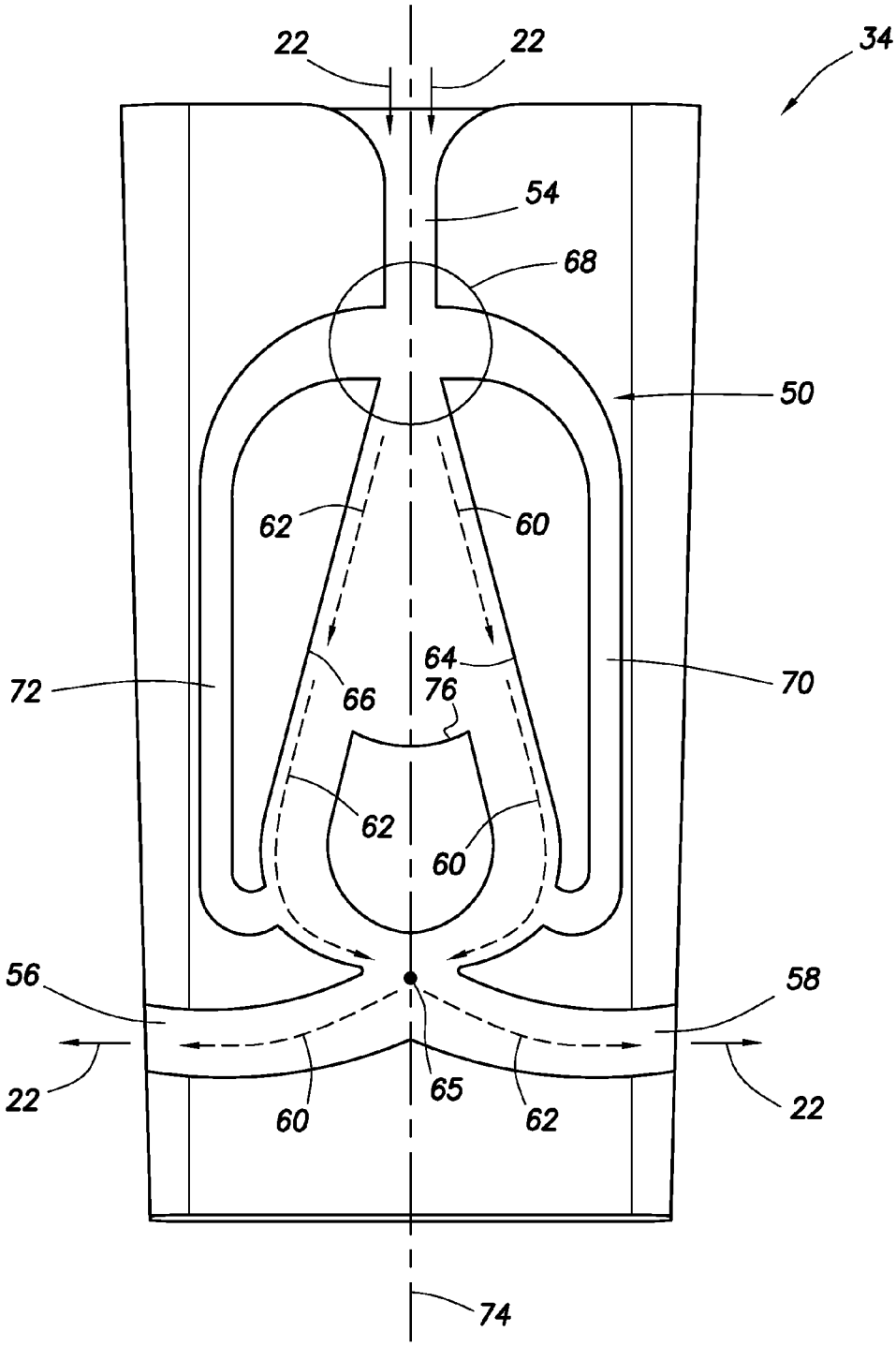

Referring additionally now to FIG. 8, another configuration of the fluidic oscillator is representatively illustrated. In this configuration, the fluid outputs 56, 58 are oppositely directed, similar to the configuration of FIG. 4, but the structure 76 is interposed between the fluid paths 60, 62, similar to the configuration of FIGS. 6 & 7.

Thus, the FIG. 8 configuration can be considered a combination of the FIGS. 4, 6 & 7 configurations. This demonstrates that any of the features of any of the configurations described herein can be used in combination with any of the other configurations, in keeping with the principles of this disclosure.

Figure 9:
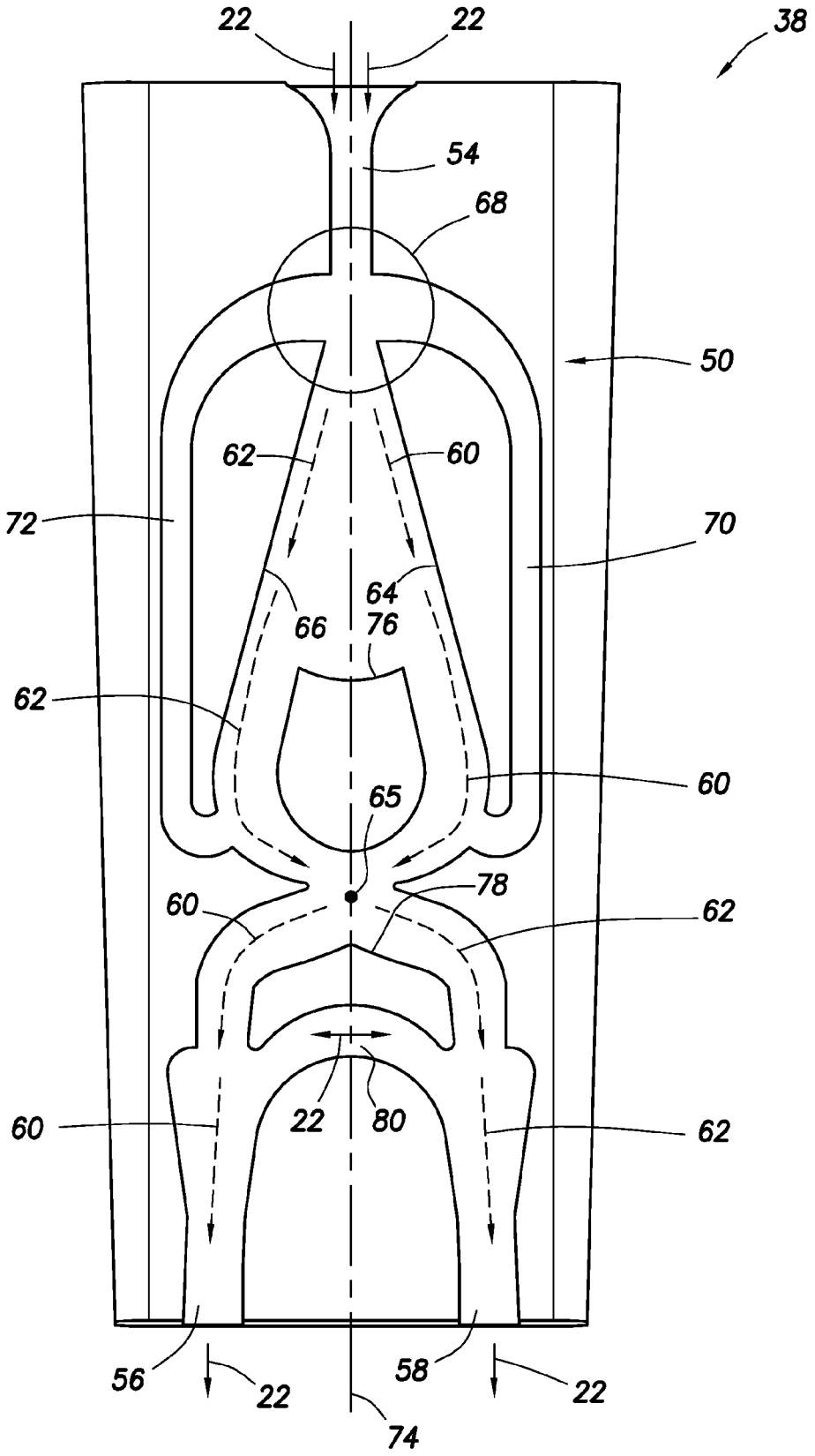

Referring additionally now to FIG. 9, another configuration of the fluidic oscillator 50 is representatively illustrated.

In this configuration, another structure 78 is interposed between the fluid paths 60, 62 downstream of the crossing 65.

The structure 78 reduces the flow areas of the fluid paths 60, 62 just upstream of a fluid path 80 which connects the fluid paths 60, 62. The velocity of the fluid 22 flowing through the fluid paths 60, 62 is increased due to the reduced flow areas of the fluid paths.

The increased velocity of the fluid 22 flowing through each of the fluid paths 60, 62 can function to draw some fluid from the other of the fluid paths. For example, when a majority of the fluid 22 flows via the fluid path 60, its increased velocity due to the presence of the structure 78 can draw some fluid through the fluid path 80 into the fluid path 60. When a majority of the fluid 22 flows via the fluid path 62, its increased velocity due to the presence of the structure 78 can draw some fluid through the fluid path 80 into the fluid path 62.

It is possible that, properly designed, this can result in more fluid being alternately discharged from the fluid outputs 56, 58 than fluid 22 being flowed into the input 54. Thus, fluid can be drawn into one of the outputs 56, 68 while fluid is being discharged from the other of the outputs.

Figure 10:
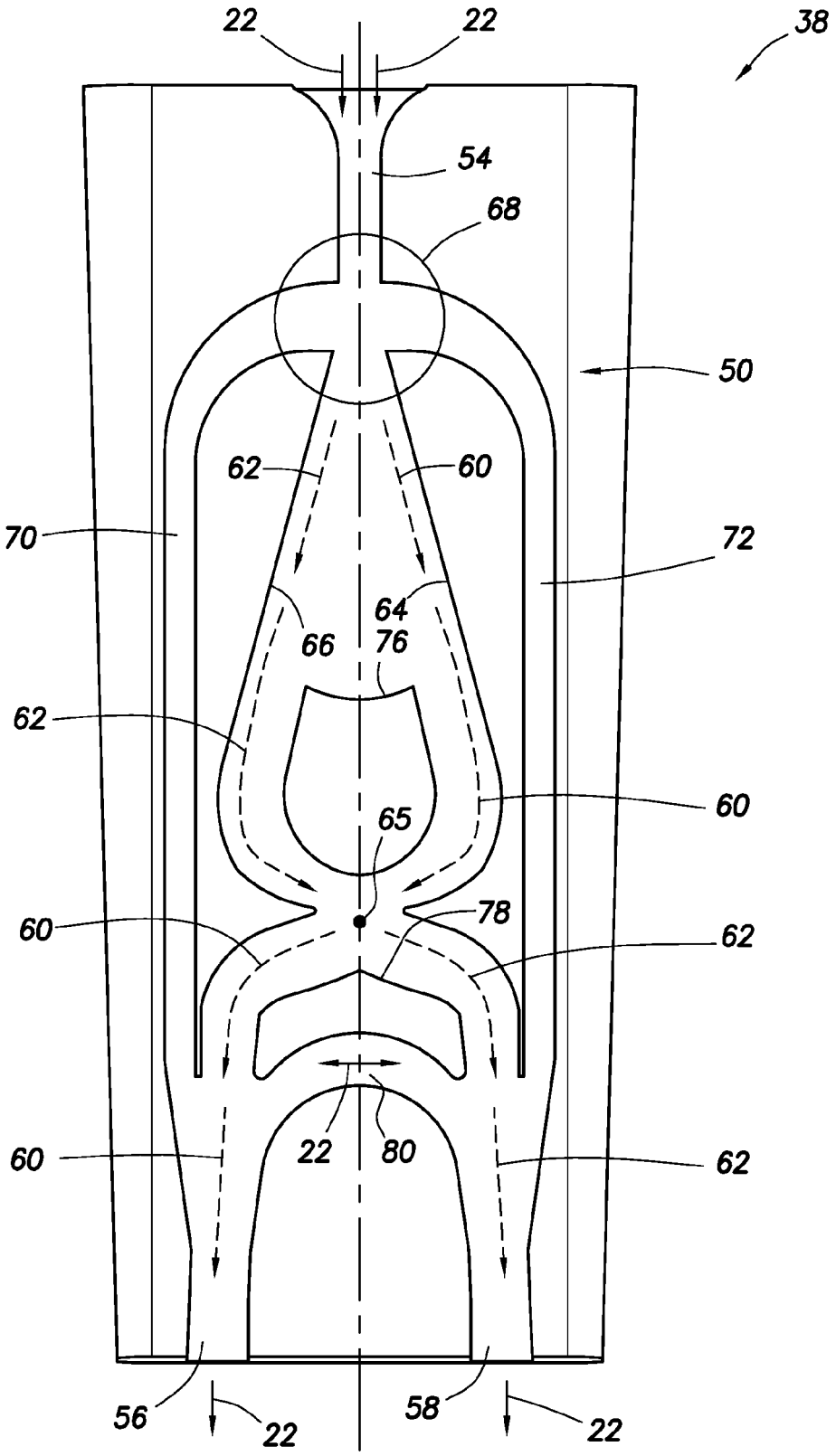

Referring additionally now to FIG. 10, another configuration of the fluidic oscillator 50 is representatively illustrated. In this configuration, computational fluid dynamics modeling has shown that a flow rate of fluid discharged from one of the outputs 56, 58 can be greater than a flow rate of fluid 22 directed into the input 54.

Fluid can be drawn from one of the outputs 56, 58 to the other output via the fluid path 80. Thus, fluid can enter one of the outputs 56, 58 while fluid is being discharged from the other output.

This is due in large part to the increased velocity of the fluid 22 caused by the structure 78 (e.g., the increased velocity of the fluid in one of the fluid paths 60, 62 causes eduction of fluid from the other of the fluid paths 60, 62 via the fluid path 80). At the intersections between the fluid paths 60, 62 and the respective feedback fluid paths 70, 72, pressure can be significantly reduced due to the increased velocity, thereby reducing pressure in the respective feedback fluid paths.

In the FIG. 10 example, a reduction in pressure in the feedback fluid path 70 will influence the fluid 22 to flow via the fluid path 62 from the fluid switch 68 (due to the relatively higher pressure in the other feedback fluid path 72). Similarly, a reduction in pressure in the feedback fluid path 72 will influence the fluid 22 to flow via the fluid path 60 from the fluid switch 68 (due to the relatively higher pressure in the other feedback fluid path 70).

One difference between the FIGS. 9 & 10 configurations is that, in the FIG. 10 configuration, the feedback fluid paths 70, 72 are connected to the respective fluid paths 60, 62 downstream of the crossing 65. Computational fluid dynamics modeling has shown that this arrangement produces desirably low frequency oscillations of flow from the outputs 56, 58, although such low frequency oscillations are not necessary in keeping with the principles of this disclosure.

The fluidic oscillator 50 of FIG. 10 creates pressure and/or flow rate oscillations in the fluid 22. As with the other fluidic oscillator 50 configurations described herein, such pressure and/or flow rate oscillations can be used for a variety of purposes. Some of these purposes can include: 1) to preferentially flow a desired fluid, 2) to reduce flow of an undesired fluid, 3) to determine viscosity of the fluid 22, 4) to determine the composition of the fluid, 5) to cut through a formation or other material with pulsating jets, 6) to generate electricity in response to vibrations or force oscillations, 7) to produce pressure and/or flow rate oscillations in produced or injected fluid flow, 8) for telemetry (e.g., to transmit signals via pressure and/or flow rate oscillations), 9) as a pressure drive for a hydraulic motor, 10) to clean well screens with pulsating flow, 11) to clean other surfaces with pulsating jets, 12) to promote uniformity of a gravel pack, 13) to enhance stimulation operations (e.g., acidizing, conformance or consolidation treatments, etc.), 14) any other operation which can be enhanced by oscillating flow rate, pressure, and/or force or displacement produced by oscillating flow rate and/or pressure, etc.

In some circumstances (such as stimulation operations, etc.), the flow rate through the fluidic oscillator 50 may remain substantially constant while a pressure differential across the fluidic oscillator oscillates. In other circumstances (such as production operations, etc.), a substantially constant pressure differential may be maintained across the fluidic oscillator while a flow rate of the fluid 22 through the fluidic oscillator oscillates.

It can now be fully appreciated that the above disclosure provides several advancements to the art of producing fluid flow oscillations. The fluidic oscillator 50 examples described above excel at producing alternating flow between the fluid outputs 56, 58.

The above disclosure provides to the art a fluidic oscillator 50 for use with a subterranean well. The fluidic oscillator 50 can include a fluid input 54, and first and second fluid outputs 56, 58 on opposite sides of a longitudinal axis 74 of the fluidic oscillator 50, whereby a majority of fluid 22 which flows through the fluidic oscillator 50 exits the fluidic oscillator 50 alternately via the first and second fluid outputs 56, 58. The fluidic oscillator 50 can also include first and second fluid paths 60, 62 from the input 54 to the respective first and second fluid outputs 56, 58, with the first and second fluid paths 60, 62 crossing each other between the fluid input 54 and the respective first and second fluid outputs 56, 58.

The fluidic oscillator 50 can also include a first feedback fluid path 70 which intersects the first fluid path 60 opposite the longitudinal axis 74 from the first fluid output 56. Increased pressure in the first feedback fluid path 70 can influence the majority of fluid 22 to flow via the second fluid path 62.

A flow area of the first fluid path 60 may be reduced downstream of an intersection between the first fluid path 60 and the first feedback fluid path 70.

The fluidic oscillator 50 can also include a fluid switch 68 at an intersection of the fluid input 54 and the first and second fluid paths 60, 62. The first feedback fluid path 70 may connect the fluid switch 68 to a location along the first fluid path 60 between the fluid switch 68 and a crossing 65 of the first and second fluid paths 60, 62.

The fluidic oscillator 50 can also include a second feedback fluid path 72 opposite the longitudinal axis 74 from the second fluid output 58. Increased pressure in the second feedback fluid path 72 can influence the majority of fluid 22 to flow via the first fluid path 60.

A flow area of the second fluid path 62 may be reduced downstream of an intersection between the second fluid path 62 and the second feedback fluid path 72.

Fluid may enter the second fluid output 58 in response to exit of the majority of fluid 22 via the first fluid output 56. Fluid may enter the first fluid output 56 in response to exit of the majority of fluid 22 via the second fluid output 58.

Flow areas of the first and second fluid paths 60, 62 may be reduced at a crossing 65 of the first and second fluid paths 60, 62.

The fluidic oscillator 50 may include a first feedback fluid path 70 which intersects the first fluid path 60, whereby reduced pressure in the first feedback fluid path 70 influences the majority of fluid to flow via the second fluid path 62. Flow of the majority of fluid 22 through the first fluid path 60 can reduce pressure in the first feedback fluid path 70.

A flow area of the first fluid path 60 may be reduced upstream of an intersection between the first fluid path 60 and the first feedback fluid path 70.

The fluidic oscillator 50 may include a fluid switch 68 at an intersection of the fluid input 54 and the first and second fluid paths 60, 62. The first feedback fluid path 70 may connect the fluid switch 68 to a location along the first fluid path 60 downstream of a crossing 65 of the first and second fluid paths 60, 62.

Flow of the majority of fluid 22 via the first fluid path 60 may draw fluid into the second fluid output 58.

Also described by the above disclosure is a fluidic oscillator 50 which can include a fluid input 54, first and second fluid outputs 56, 58 (whereby a majority of fluid 22 which flows through the fluidic oscillator 50 exits the fluidic oscillator 50 alternately via the first and second fluid outputs 56, 58), first and second fluid paths 60, 62 from the input 54 to the respective first and second outputs 56, 58, and a first feedback fluid path 70 which intersects the first fluid path 60, whereby reduced pressure in the first feedback fluid path 70 influences the majority of fluid 22 to flow via the second fluid path 62.

Flow of the majority of fluid 22 through the first fluid path 60 may reduce pressure in the first feedback fluid path 70.

A flow area of the first fluid path 60 may be reduced upstream of an intersection between the first fluid path 60 and the first feedback fluid path 70.

The fluidic oscillator 50 can include a fluid switch 68 at an intersection of the fluid input 54 and the first and second fluid paths 60, 62. The first feedback fluid path 70 may connect the fluid switch 68 to a location along the first fluid path 60 downstream of a crossing 65 of the first and second fluid paths 60, 62.

Flow of the majority of fluid 22 via the first fluid path 60 can draw fluid into the second fluid output 58.

The first and second fluid paths 60, 62 may cross each other between the fluid input 54 and the respective first and second fluid outputs 56, 58.

Fluid may enter the second fluid output 58 in response to exit of the majority of fluid 22 via the first fluid output 56. Fluid may enter the first fluid output 56 in response to exit of the majority of fluid 22 via the second fluid output 58.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A fluidic oscillator for use with a subterranean well, the fluidic oscillator comprising:

a fluid input, which receives fluid that flows in the subterranean well;

first and second fluid outputs on opposite sides of a longitudinal axis of the fluidic oscillator, whereby a majority of fluid which flows through the fluidic oscillator exits the fluidic oscillator alternately via the first and second fluid outputs;

first and second fluid paths from the fluid input to the respective first and second fluid outputs; and wherein the first and second fluid paths cross each other between the fluid input and the respective first and second fluid outputs, and wherein flow of the majority of fluid via the first fluid path draws fluid into the second fluid output.

2. The fluidic oscillator of claim 1, further comprising a first feedback fluid path which intersects the first fluid path opposite the longitudinal axis from the first fluid output, whereby increased pressure in the first feedback fluid path influences the majority of fluid to flow via the second fluid path.

3. The fluidic oscillator of claim 2, wherein a flow area of the first fluid path is reduced downstream of an intersection between the first fluid path and the first feedback fluid path.

4. The fluidic oscillator of claim 2, further comprising a fluid switch at an intersection of the fluid input and the first and second fluid paths, and wherein the first feedback fluid path connects the fluid switch to a location along the first fluid path between the fluid switch and a crossing of the first and second fluid paths.

5. The fluidic oscillator of claim 2, further comprising a second feedback fluid path opposite the longitudinal axis from the second fluid output, whereby increased pressure in the second feedback fluid path influences the majority of fluid to flow via the first fluid path.

6. The fluidic oscillator of claim 5, wherein a flow area of the second fluid path is reduced downstream of an intersection between the second fluid path and the second feedback fluid path.

7. The fluidic oscillator of claim 1, wherein fluid enters the first fluid output in response to exit of the majority of fluid via the second fluid output.

8. The fluidic oscillator of claim 1, wherein flow areas of the first and second fluid paths are reduced at a crossing of the first and second fluid paths.

9. The fluidic oscillator of claim 1, further comprising a first feedback fluid path which intersects the first fluid path, whereby reduced pressure in the first feedback fluid path influences the majority of fluid to flow via the second fluid path.

10. The fluidic oscillator of claim 9, wherein flow of the majority of fluid through the first fluid path reduces pressure in the first feedback fluid path.

11. The fluidic oscillator of claim 9, wherein a flow area of the first fluid path is reduced upstream of an intersection between the first fluid path and the first feedback fluid path.

12. The fluidic oscillator of claim 9, further comprising a fluid switch at an intersection of the fluid input and the first and second fluid paths, and wherein the first feedback fluid path connects the fluid switch to a location along the first fluid path downstream of a crossing of the first and second fluid paths.

13. A fluidic oscillator for use with a subterranean well, the fluidic oscillator comprising:

a fluid input, which receives fluid that flows in the subterranean well;

first and second fluid outputs, whereby a majority of fluid which flows through the fluidic oscillator exits the fluidic oscillator alternately via the first and second fluid outputs;

first and second fluid paths from the fluid input to the respective first and second fluid outputs, wherein flow areas of the first and second fluid paths are reduced at a crossing of the first and second fluid paths; and a feedback fluid path which intersects the first fluid path, whereby reduced pressure in the feedback fluid path influences the majority of fluid to flow via the second fluid path.

14. The fluidic oscillator of claim 13, wherein flow of the majority of fluid through the first fluid path reduces pressure in the feedback fluid path.

15. The fluidic oscillator of claim 13, wherein a flow area of the first fluid path is reduced upstream of an intersection between the first fluid path and the feedback fluid path.

16. The fluidic oscillator of claim 13, further comprising a fluid switch at an intersection of the fluid input and the first and second fluid paths, and wherein the feedback fluid path connects the fluid switch to a location along the first fluid path downstream of a crossing of the first and second fluid paths.

17. The fluidic oscillator of claim 13, wherein flow of the majority of fluid via the first fluid path draws fluid into the second fluid output.

18. The fluidic oscillator of claim 13, wherein the first and second fluid paths cross each other between the fluid input and the respective first and second fluid outputs.

19. The fluidic oscillator of claim 13, wherein fluid enters the second fluid output in response to exit of the majority of fluid via the first fluid output.

20. The fluidic oscillator of claim 19, wherein fluid enters the first fluid output in response to exit of the majority of fluid via the second fluid output.

* * * * *